US005389035A

United States Patent [19]

Ishida et al.

[11] Patent Number: 5,389,035

[45] Date of Patent: Feb. 14, 1995

[54] VENTILATING APPARATUS FOR A VEHICLE

[75] Inventors: Takeshi Ishida, Kobe; Hiroki Hayashi, Miki, both of Japan

[73] Assignee: Kawasaki Jukogyo Kabushiki Kaisha, Kobe, Japan

[21] Appl. No.: 197,553

[22] Filed: Feb. 17, 1994

Related U.S. Application Data

[63] Continuation-in-part of Ser. No. 967,013, Oct. 27, 1992.

[51] Int. Cl.[6] ..... B61D 27/00

[52] U.S. Cl. ..... 454/99; 454/115

[58] Field of Search ..... 454/76, 99, 100, 103, 454/105, 115

[56] References Cited

U.S. PATENT DOCUMENTS

| | | | |
|---|---|---|---|
| 2,100,834 | 11/1937 | Chapman | 454/105 X |
| 2,212,897 | 8/1940 | Crawford et al. | 454/99 X |
| 2,256,350 | 9/1941 | Nystrom | 454/99 X |
| 2,383,423 | 8/1945 | Steins | 454/99 |
| 2,698,569 | 1/1955 | Reynolds et al. . | |
| 3,343,473 | 9/1967 | Gillick et al. | 454/99 |

FOREIGN PATENT DOCUMENTS

| | | | |
|---|---|---|---|
| 0114981 | 12/1983 | European Pat. Off. . | |
| 63-199170 | 8/1988 | Japan . | |
| 1-18766 | 1/1989 | Japan . | |
| 200514 | 8/1990 | Japan | 454/99 |

*Primary Examiner*—Harold Joyce
*Attorney, Agent, or Firm*—Leydig, Voit & Mayer

[57] ABSTRACT

A ventilating apparatus for a conveyance has a first conduit disposed on the upper portion of a vehicle so as to supply conditioned air allowed to flow from an air conditioned device into a compartment, a second conduit disposed in the lower portion of the vehicle so as to suck and circulate air in the compartment, a a third conduit disposed in the lower portion of the vehicle so as to suck and introduce air in the compartment into an exhaust device. The air conditioning device conditions air by mixing air circulated from the second conduit and air sucked from the outside of the compartment by a suction device. When the compartment is partitioned, the ventilating apparatus is individually provided for each partitioned compartment and the third conduit is connected to a discharge port of a lavatory.

29 Claims, 11 Drawing Sheets

VENTILATING APPARATUS FOR A VEHICLE

This application is a continuation-in-part application of application Ser. No. 967,013, filed on Oct. 27, 1992.

BACKGROUND OF THE INVENTION

1. Field of the Invention

The present invention relates to an apparatus for ventilating a compartment of a conveyance typified by, for example, a railway vehicle.

2. Related Art Statement

As a typical conventional technology, there are a ventilating apparatus having relaxation means for changing the ventilation passage connected to an air blower and disclosed in Japanese Patent Laid-Open No. 63-199170, a ventilating apparatus having a Roots fan for sucking/exhausting air and disclosed in Japanese Patent Laid-Open No. 64-18766, and a structure having a plurality of pairs each of which is composed of an air blowing opening and an air suction opening formed in the roof surface and arranged in such a manner that the plurality of the pairs are combined with an exclusive air conditioning apparatus. Then, a typical example of the conventional structures will now be described with reference to FIG. 11 which is a plan view from which a portion is omitted.

Referring to FIG. 11, a suction means 2 is disposed in the upper portion of a railway vehicle 1, for example, in a portion between the ceiling and the roof. Outside air introduced by the suction means 2 is branched into two sections after it has passed through an air passage 3. One of the branched air flows is supplied to an air conditioning means 4 via an air passage 3*a*, while the residual air flow is supplied to another air conditioning means 9 via an air passage 3*b*.

The air conditioning means 4 and 9 are also respectively supplied with circulated air which has flowed through circulation ports 5 and 14 and circulation ports 10 and 15 formed at arbitrary positions of the ceiling via air passages 6 and 16 and air passages 11 and 17.

Circulated air and fresh air introduced from the outside of the vehicle are mixed with each other by the air conditioning means 4 and 9 so as to be conditioned with each other, and they are supplied to corresponding muffling means 7 and 13 and introduced into a duct 8.

The duct 8 uniformly introduces conditioned air into the compartment and also supplies conditioned air to required portions, for example, a driver's cabin and a lavatory.

Air circulated in the compartment is, via an individual duct, introduced into an exhaust means through exhaust ports formed in the floor, and is exhausted to the outside of the vehicle through this exhaust means.

FIG. 12 is a schematic cross sectional view taken along a cross sectional line XII—XII of FIG. 11. The air passages 3*a* and 3*b* are formed by partitioning the inside portion of an outer surface 18 of a vehicle body 1 by partition 19.

FIG. 13 is a cross sectional view taken along a cross sectional line XIII—XIII of FIG. 11. The air passages 3*b* and 12 are formed in such a manner that they are partitioned by a partition member 20.

FIG. 14 is a cross sectional view taken along a cross sectional line XIV—XIV of FIG. 11. In this portion, only the air passage 3*b* is formed.

The structure thus arranged encounters a problem that odor from a lavatory can be mixed with the circulating air in the case where a lavatory is located in the vehicle body. In order to overcome the aforesaid problem, an exclusive exhaust means and an exhaust passage for the lavatory are individually provided in the aforesaid conventional structure. In this case, the number of the facilities and equipment cannot be decreased, causing the structure to be complicated and causing the cost to be enlarged.

Furthermore, the configuration of the facilities is too complicated as shown in FIGS. 11 to 14 and therefore the construction cannot be easily established. Therefore, the conventional structure cannot be manufactured easily.

What is worse, it is difficult for each of the air passages to keep a required cross sectional area due to a limitation of the installation space. Therefore, a problem of noise usually takes place due to the cooling and heating performance, the air quantity and the wind velocity.

Since the conventional structure is composed of a single ventilation system in the overall vehicle, another problem arises in that the overall function is stopped when the ventilating apparatus becomes defective. Furthermore, the compartment cannot be divided into smoking inhibited seats and permitted seats because the circulated air is not separated. Furthermore, space available for the air ducts is normally very restricted, so the cross-sectional area of each duct is very limited. Consequently, the air conditioning efficiency is reduced when the air flow rate is decreased, and noise caused by the air flow increases when the air flow rate is increased.

SUMMARY OF THE INVENTION

An object of the present invention is to provide a ventilating apparatus for a vehicle, the structure and the construction of which can be simplified, which can be easily manufactured, which is capable of eliminating noise while maintaining a desired air conditioning performance and keeping a proper air quantity and wind velocity, with which a necessity of providing exclusive discharge means for a lavatory can be eliminated, in which, even if either of the ventilating apparatuses has encountered a malfunction, the residual ventilating apparatus is able to be operated so that the influence of the malfunction is reduced, and with which the atmosphere of each compartment can be maintained because the compartment is sectioned as desired and influence between other compartments can be prevented so that the function of the vehicle is improved.

According to the present invention, there is provided a ventilating apparatus for a vehicle comprising: a first conduit for supplying conditioned air into a compartment; a second conduit for circulating air in the compartment; a third conduit for exhausting air in the compartment; ventilating means for sucking air from the outside of the compartment and for exhausting air to the outside of the compartment; and air conditioning means which mixes, with each other, air sucked from the outside of the compartment via the ventilating means and air circulated from the inside of the compartment via the second conduit so as to make them conditioned air, wherein the first conduit is disposed in the upper portion of a vehicle and is connected to the air conditioning means via a rising conduit arranged from the upper portion of the vehicle to the lower portion of the vehicle and a horizontal conduit disposed under the floor of the vehicle, the second conduit is disposed in the lower portion of the vehicle adjacent to the floor and is connected to the air conditioning means, and the third conduit is disposed adjacent to the floor of the vehicle in the lower portion of the vehicle and is connected to the ventilating means.

The present invention is also characterized in that two ventilating systems are provided for one vehicle and at least of the first conduits of the two ventilating systems are connected to each other.

Furthermore, the present invention is characterized in that the inside of the vehicle is partitioned into a plurality of compartments or sections by insulating walls, and each of the partitioned compartments is provided with the ventilating apparatus each having the first, second, and third conduits.

In addition, the present invention is characterized in that the third conduit is connected to an exhaust port formed in a lavatory.

The present invention is further characterized in that the ventilating means is constituted by integrally forming suction means for sucking air from the outside of the vehicle and an exhaust means for exhausting air from the inside of the vehicle.

The present invention is also characterized in that a silencer is provided for the rising conduit.

According to the present invention, conditioned air supplied from the air conditioning means disposed in the lower portion is, via the horizontal conduit and the rising conduit, supplied to the first conduit disposed in the upper portion, the supplied air being then supplied to the inside of the compartment through the first conduit. The second conduit disposed in the lower portion introduces air in the compartment so as to circulate it to the air conditioning means. The air conditioning means is also supplied with air from the outside of the vehicle introduced by the suction means included by the ventilating means so as to be mixed with circulated air. The third conduit is further disposed in the lower portion so as to introduce air in the compartment to be exhausted so as to be exhausted to the outside of the vehicle by the exhaust means included by the ventilating means. Therefore, only the first conduit is disposed in the upper portion, while the second and the third conduits are respectively individually disposed. Hence, each of the conduits is able to have a sufficiently large cross sectional area, causing a proper air quantity to be kept. Therefore, noise can be eliminated satisfactorily while necessitating a simple structure.

According to the present invention, the inside of a vehicle can be partitioned into a plurality of compartments or sections, such as a smoking compartment and a non-smoking compartment, and a separate ventilating system can be provided for each compartment. As a result, contaminated air from one compartment can be prevented from being introduced into another compartment.

Other and further objects, features and advantages of the invention will be appear more fully from the following description.

DESCRIPTION OF THE PREFERRED EMBODIMENTS

Figure 1:
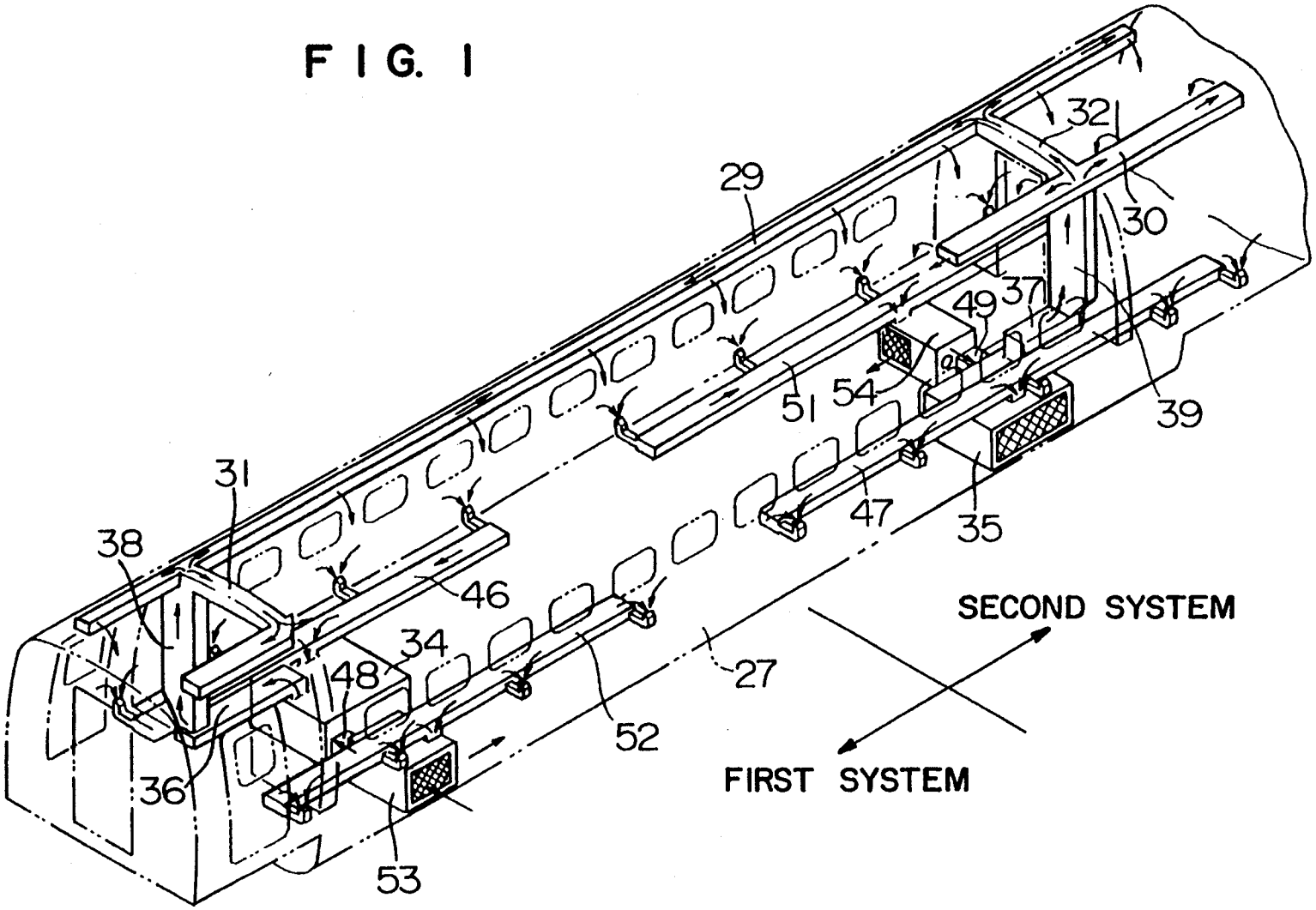
FIG. 1 is a schematic and perspective view which illustrates an embodiment of the present invention adapted to a railway vehicle 27.
Figure 2:
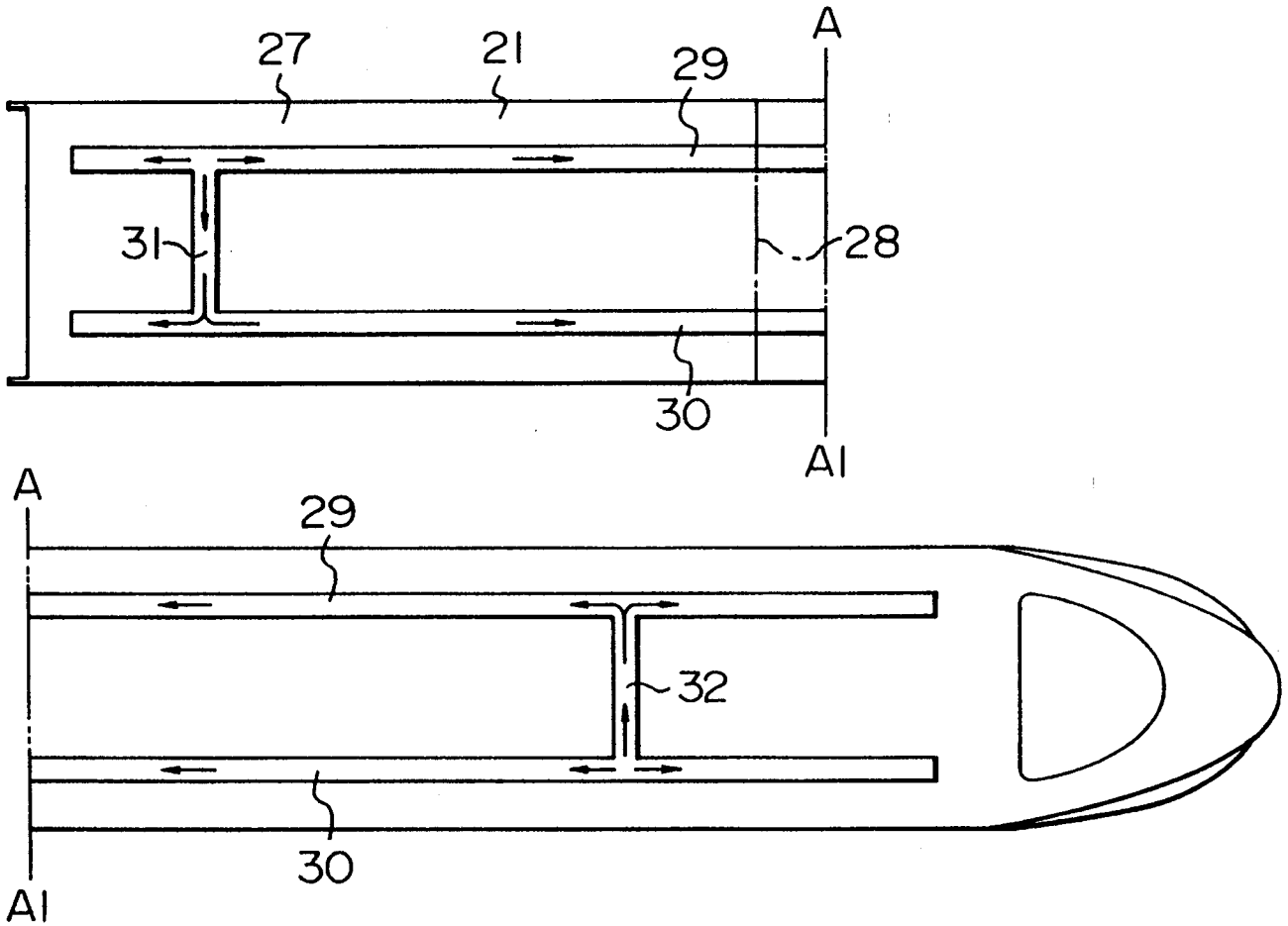
FIG. 2 is a schematic plan view which illustrates the structure of the upper portion of the embodiment.
Figure 3:
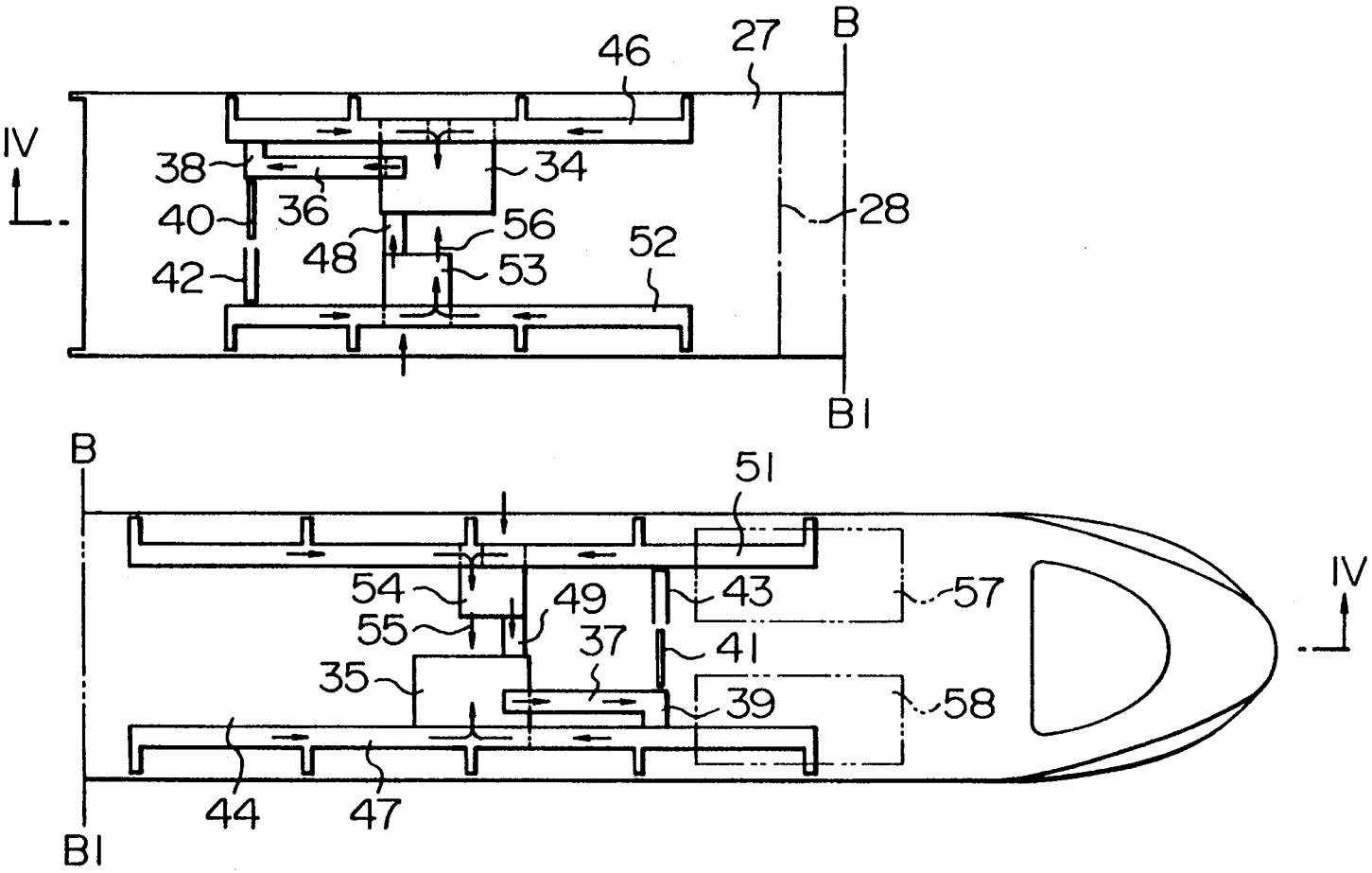
FIG. 3 is a schematic plan view which illustrates the structure of the lower portion of the vehicle 27 according to the embodiment of the present invention.
Figure 4:
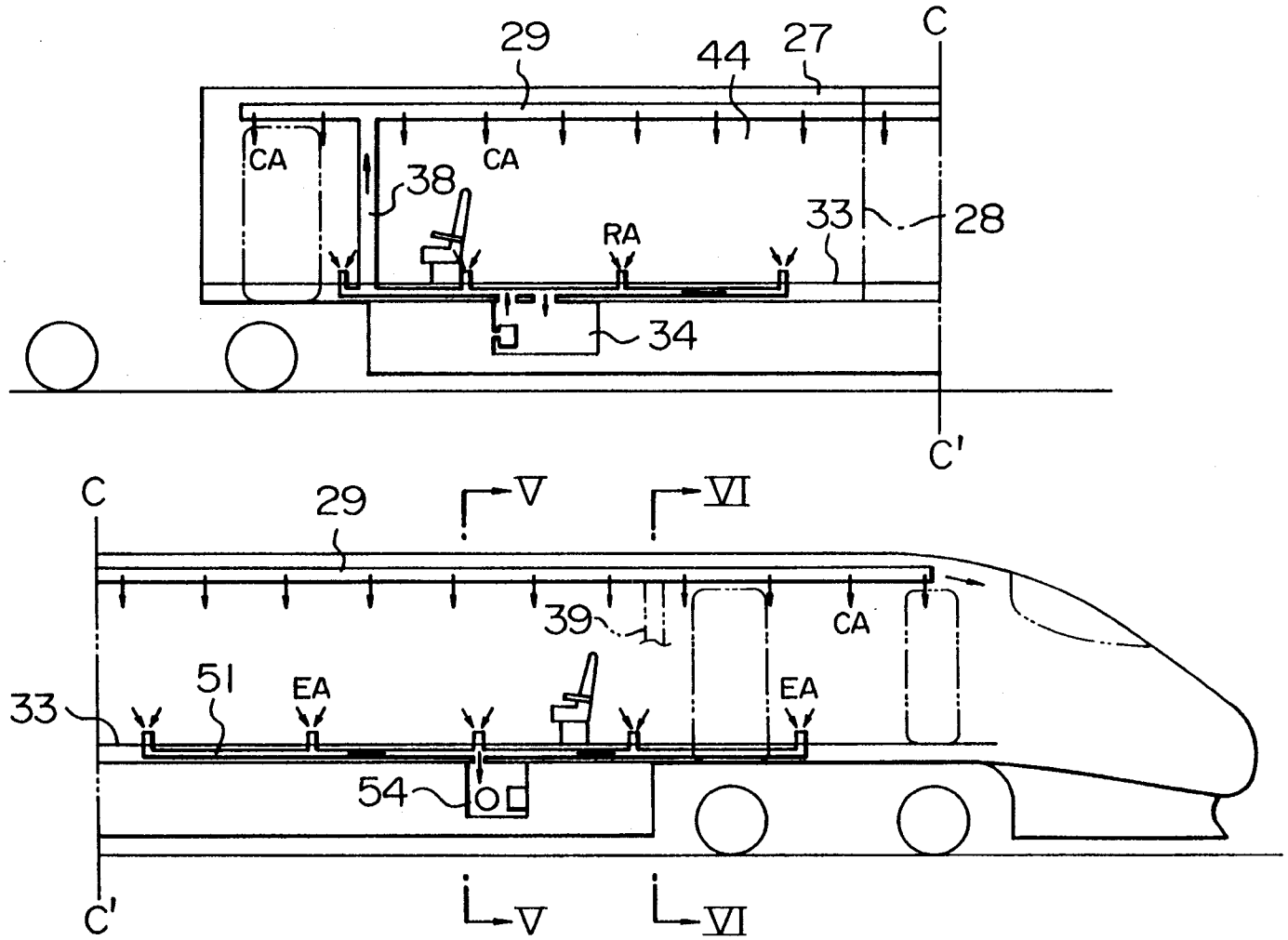
FIG. 4 is a schematic cross sectional view taken along a cross sectional line IV—IV of FIG. 3.
Figure 5:
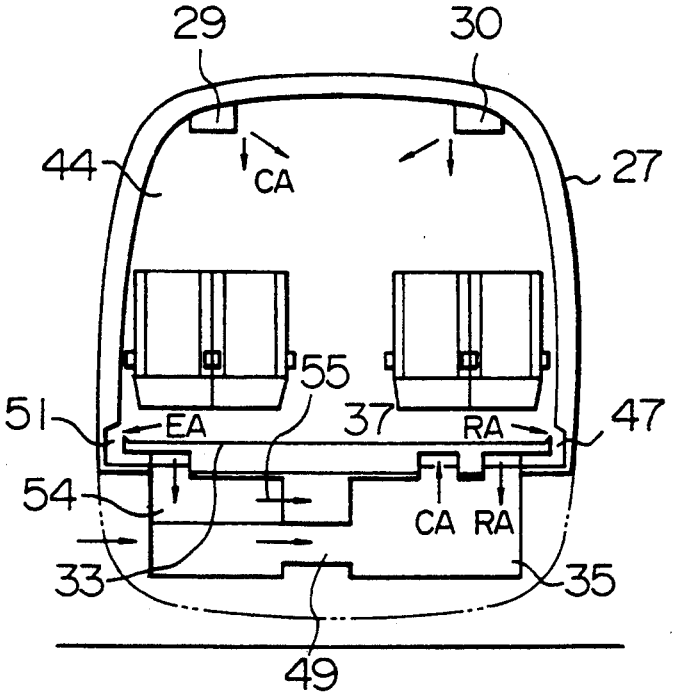
FIG. 5 is a schematic cross sectional view taken along a cross sectional line V—V of FIG. 4.
Figure 6:
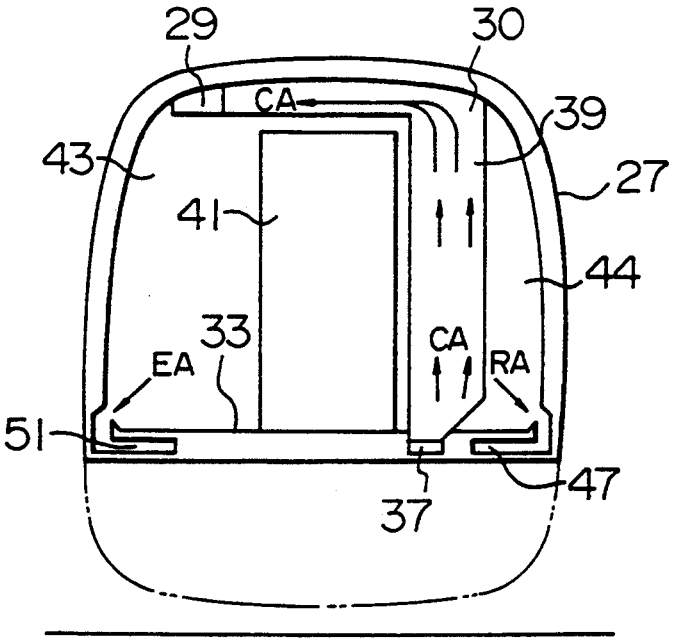
FIG. 6 is a schematic cross sectional view taken along a cross sectional line VI—VI of FIG. 4.
Figure 7:
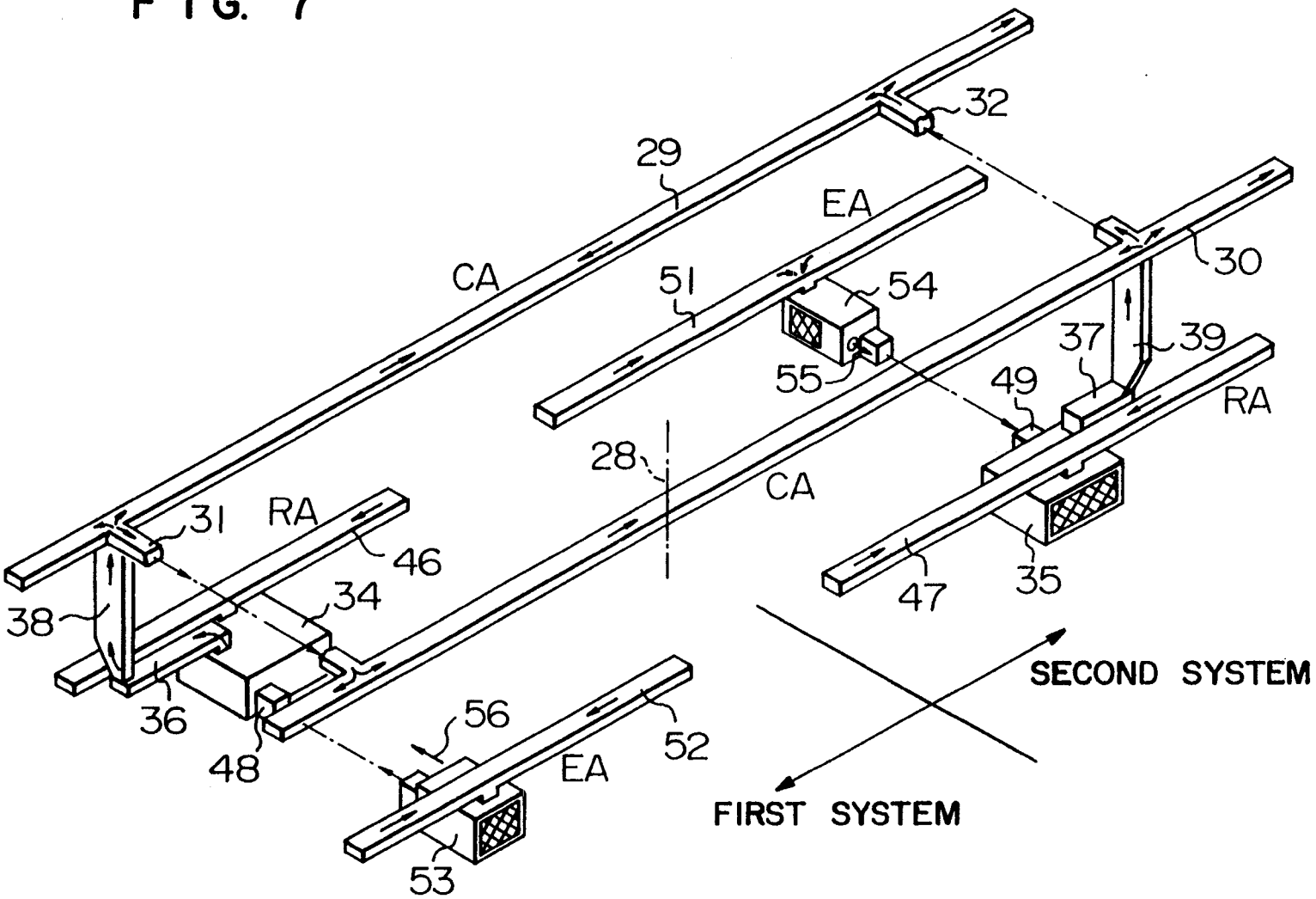
FIG. 7 is a partially schematic perspective view which illustrates the embodiment shown in FIGS. 1 to 6.

FIG. 1 is a schematic and perspective view which illustrates an embodiment of the present invention constituted in such a manner that a ventilating apparatus is provided for a railway vehicle 27 which is an example of a vehicle to which the present invention can be applied. FIG. 2 is a schematic plan view which illustrates the upper structure of this embodiment. FIG. 3 is a schematic plan view which illustrates the structure of the lower portion of the vehicle 27. FIG. 4 is a schematic cross sectional view taken along a cross sectional line IV—IV of FIG. 3, FIG. 5 is a schematic cross sectional view taken along a cross sectional line V—V of FIG. 4, and FIG. 6 is a schematic cross sectional view taken along a cross sectional line VI—VI of FIG. 4. With reference to these drawings and FIG. 7 which is a schematic view of the ventilating apparatus for a vehicle, the embodiment of the present invention will now be described.

This embodiment is constituted in such a manner that the ventilating apparatus is disposed substantially axis symmetrically with respect to a symmetric axis 28 vertically extending from the surface of the drawing sheets on which FIGS. 2 and 3 are drawn. As shown in FIG. 1, this embodiment of a ventilating apparatus includes a first ventilating system and a second ventilating system disposed on opposite sides of the symmetric axis. However, the same effect can be obtained even if the configuration of the ventilating apparatus is made plane symmetric, that is, mirror symmetric with respect to a symmetric plane designated by an alternate long and short dash line which passes through the symmetric axis 28. The vehicle 27 has first conduits 29 and 30 on both sides of the upper portion thereof. The right and the left first conduits 29 and 30 are connected to each other at predetermined positions of the vehicle 27 by connecting conduits 31 and 32. Air conditioning means 34 and 35 are disposed below a floor 33 of the vehicle 27. Conditioned air cooled or heated by the air conditioning means 34 and 35 is passed through horizontal conduits 36 and 37 disposed below and along the floor 33 and also passed through rising conduits 38 and 39 so that the cooled or heated air is supplied to the first conduits 29 and 30. It is preferable to form the rising conduits 38 and 39 by utilizing partition walls or bulkheads which partition the inside of the vehicle 27 into a plurality of compartments and also preferable to make them to be included at positions opposing door pockets 42 and 43 for doors 40 and 41. As a result, the rising conduits 38 and 39 are given sufficiently large cross sectional areas while enabling the doors 40 and 41 to be smoothly opened/-closed.

Since relatively large spaces can be obtained in the aforesaid case, a muffling means for muffling noise generated by the air conditioning means 34 and 35 can be located. Specifically, the rising conduits 38 and 39 may be formed into silencers.

Furthermore, this embodiment is arranged in such a manner that second conduits 46 and 47 for return air from a compartment 44 of the vehicle 27 are disposed adjacent to the floor 33 in the lower portion of the vehicle 27 to face the compartment 44 of the vehicle 27, the second conduits 46 and 47 being disposed axial symmetrically as described above. Return air from the compartment 44 is introduced through the second conduits 46 and 47 so that it is returned to the air conditioning means 34 and 35. The air conditioning means 34 and 35 are, via air supply conduits 48 and 49, supplied with outdoor fresh air by suction means of ventilating means 53 and 54 each of which comprises an axial fan. In the air conditioning means 34 and 35, circulated air passed from the second conduits 46 and 47 and air passed from the air supply conduits 48 and 49 are mixed with each other so that conditioned air is again passed to the horizontal conduits 36 and 37.

Furthermore, third conduits 51 and 52 facing the compartment are axial-symmetrically disposed in the lower portion of the vehicle 27 adjacent to the floor 33, the third conduits 51 and 52 being arranged to discharge the air in the compartment 44 to the outside of the vehicle 27. Ventilating means 53 and 54 each comprising an axial fan are connected to the third conduits 51 and 52. The ventilating means 53 and 54 are disposed below the floor 33, the ventilating means 53 and 54 each including a discharge means for discharging air 55 and 56 in the compartment 44 and suction means for sucking outdoor air to supply it to the compartment 44.

The case where a lavatory and a wash room are placed in the vehicle 27 will now be described. In the case where the lavatory and the like are placed at positions designated by phantom lines of FIG. 3, a lavatory 57 which emits odor is placed in the vicinity of the third conduit 51, while a wash room 58 which does not emit odor is placed in the vicinity of the second conduit 47 which opposes the third conduit 51. Each of the exhaust ports of the lavatory 57 and the wash room 58 is connected to the third conduit 51 or the second conduit 47. As a result, the lavatory 57 is connected to the third conduit 51 which exclusively exhaust air while been insulated from the second conduit 47 which exclusively returns air. Hence, the odor of the lavatory cannot mix with the return air and therefore the necessity of providing an individual exhaust means for the lavatory can be eliminated.

Figure 8:
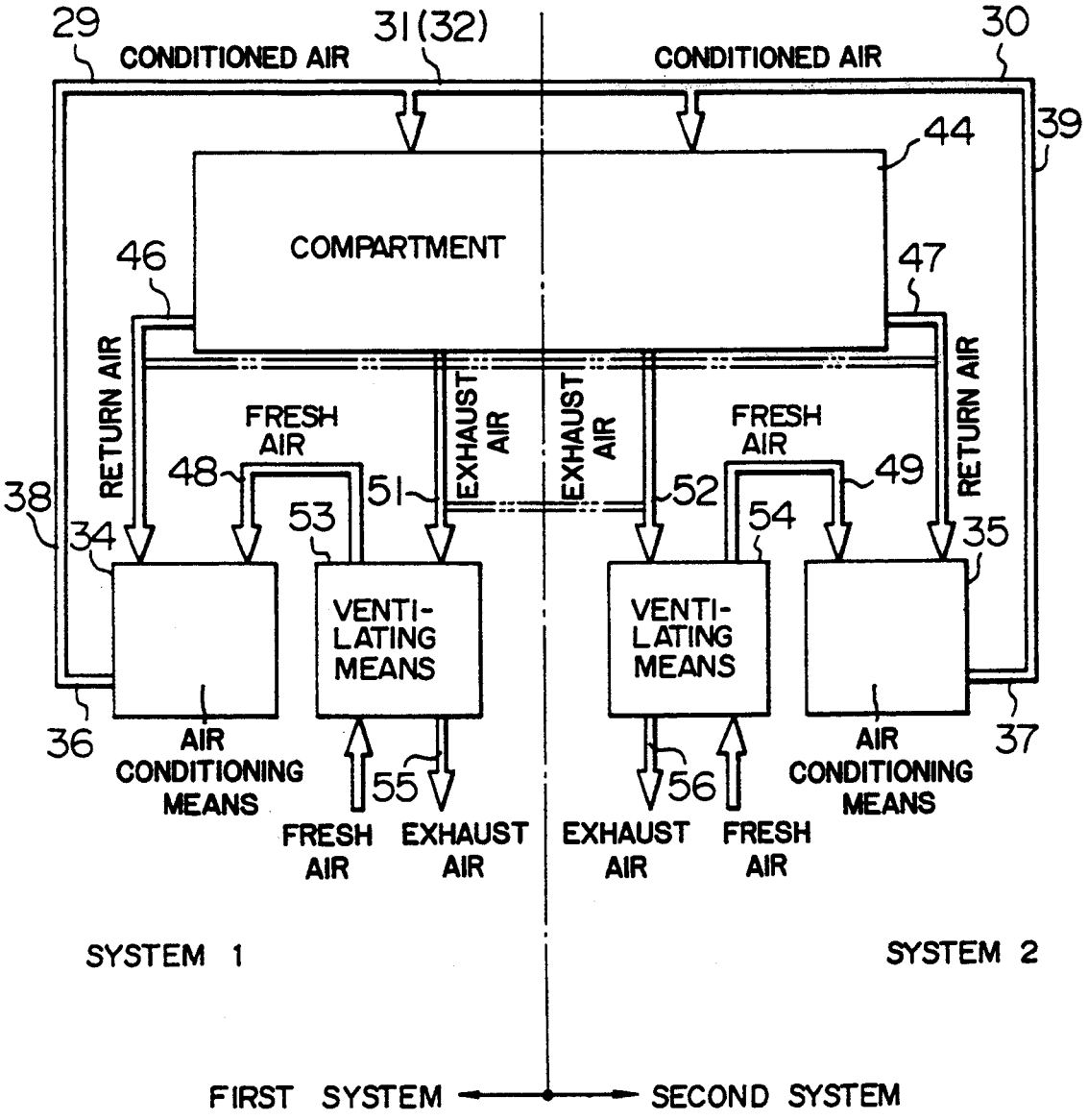
FIG. 8 is a block diagram which illustrates the system according to embodiment of the present invention.

FIG. 8 is a block diagram which schematically illustrates this embodiment, showing how a single compartment 44 is equipped with a ventilating apparatus comprising two systems 44. The first conduits 29 and 30 included by the two systems are connected to each other by the connecting pipes 31 and 32. If necessary, the second conduits 46 and 47 may be connected to each other and the third conduits 51 and 52 may be connected to each other. In this case, the second system is able to compensate for a malfunction of the first system. According to this embodiment thus arranged, each of the first conduits 29 and 30, the second conduits 46 and 47 and the third conduits 51 and 52 can be individually and simply constituted. Consequently, the overall structure of the system can be simplified while overcoming the aforesaid problems experienced with the conventional technologies and structures. Since each of the aforesaid components can be disposed in arbitrary directions in the vehicle while being satisfactorily balanced, each of the conduits 29, 30, 46, 47, 51 and 52 is able to have a sufficient and proper large cross sectional area while satisfactorily preventing the undesirable loss. Hence, air of a required quantity can be introduced through each of the aforesaid conduits. Therefore, the problem taken place in that the compartment 44 cannot keep a satisfactorily large space can be overcome.

It can be seen from FIG. 8 that in this embodiment, each of the first and second systems is equipped with its own first conduit, second conduit, third conduit, air conditioning means, and ventilating means. Furthermore, it can be seen that at least one of the first conduits of each system is connected to a first conduit of the other system.

Figure 9:
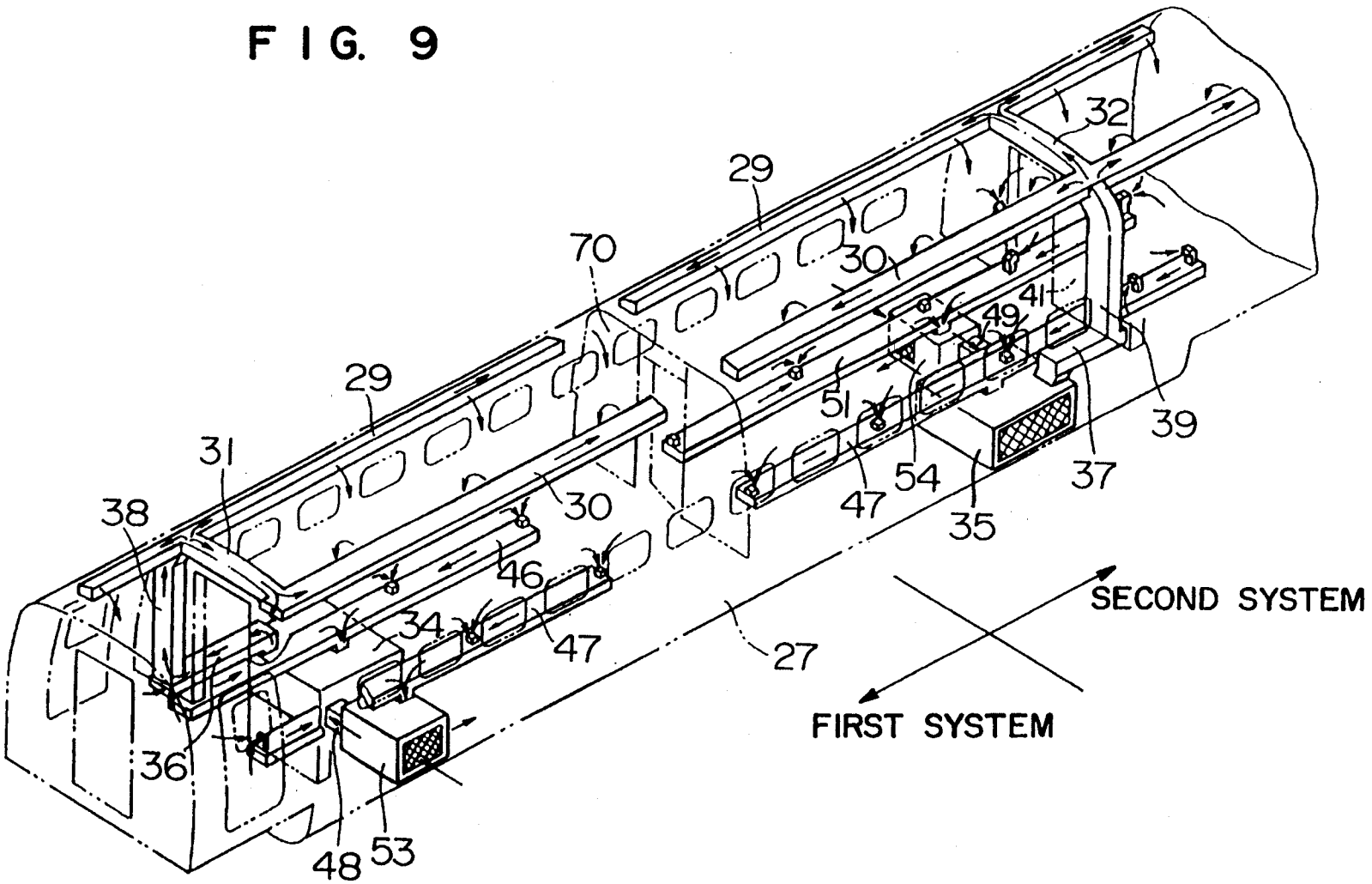
FIG. 9 is a schematic perspective view which illustrates another embodiment of the present invention adapted to a railway vehicle.
Figure 10:
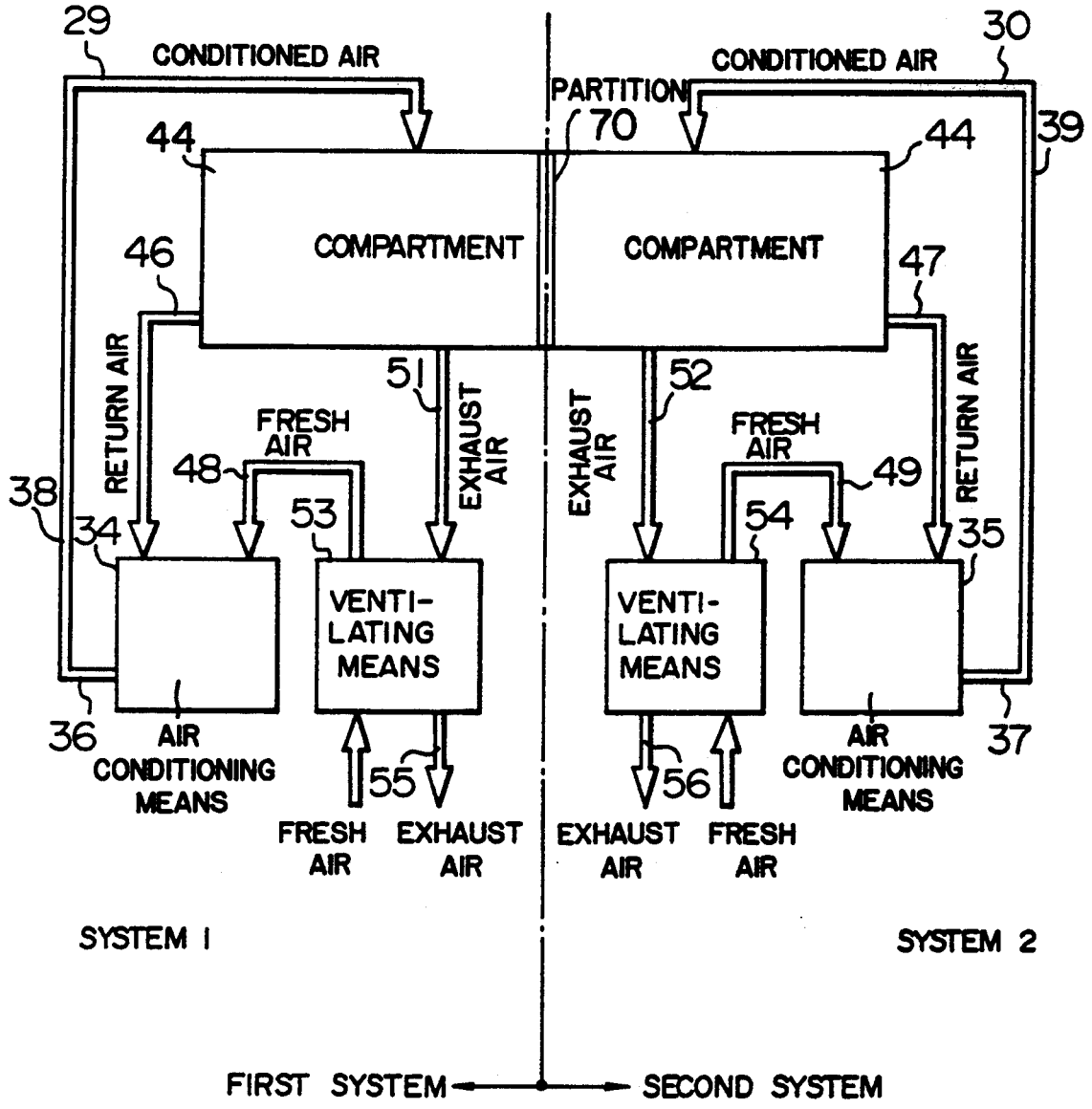
FIG. 10 is a block diagram which illustrates the system according to the other embodiment of the present invention.
Figure 11:
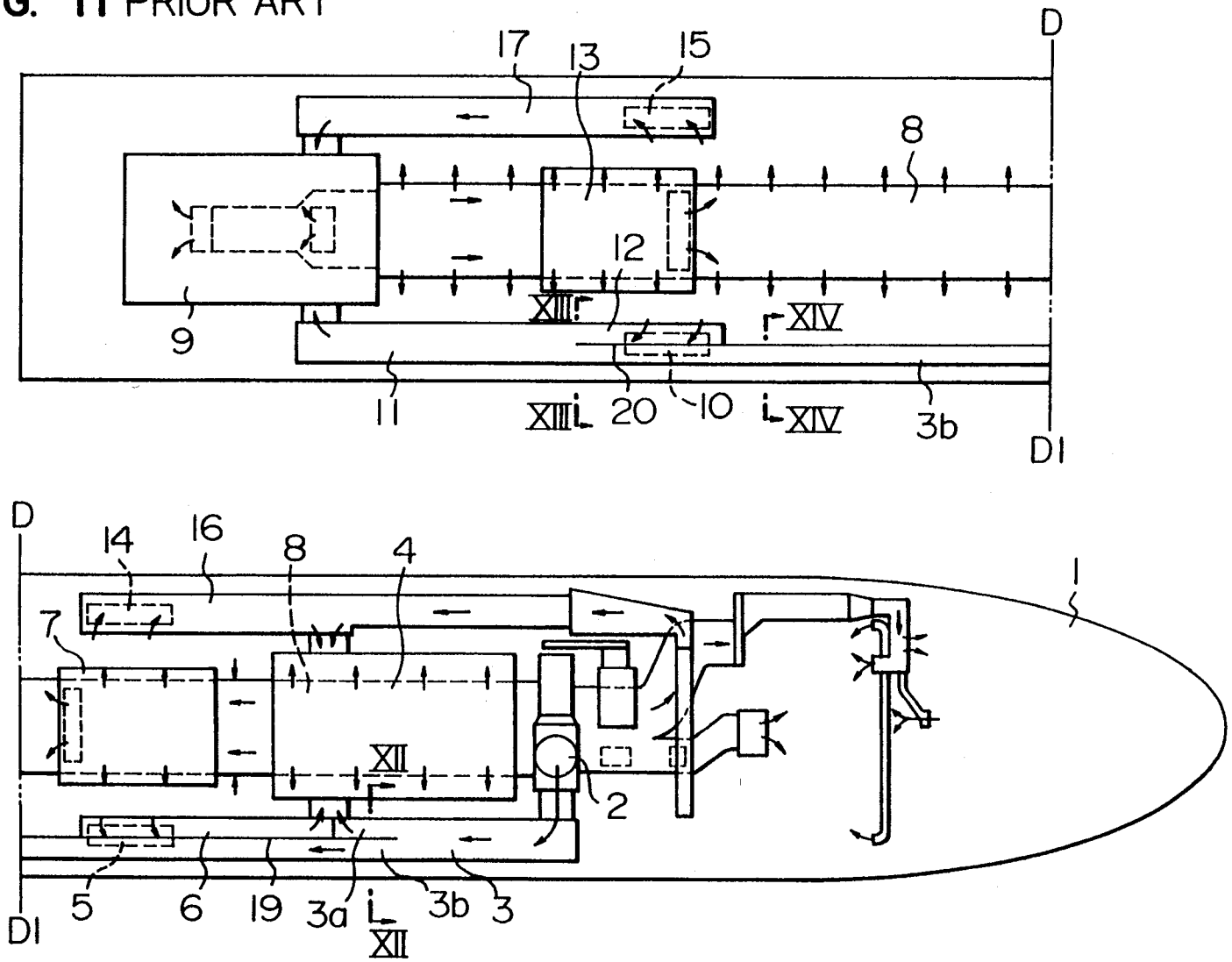
FIG. 11 PRIOR ART
FIG. 11 is partial plan view which illustrates a conventional ventilating apparatus.
Figure 12:
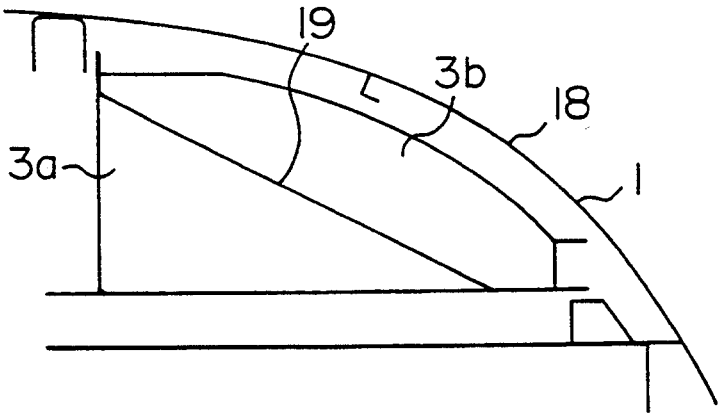
FIG. 12 PRIOR ART
FIG. 12 is a schematic cross sectional view taken along a cross sectional line XII—XII of FIG. 11.
Figure 13:
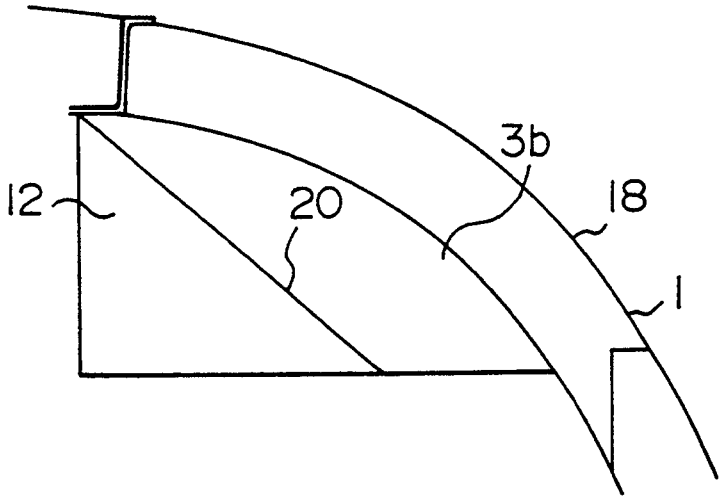
FIG. 13 PRIOR ART
FIG. 13 is a schematic cross sectional view taken along a cross sectional line XIII—XIII of FIG. 11.
Figure 14:
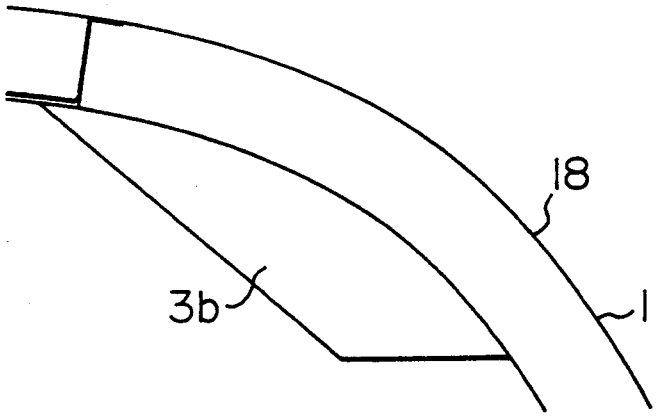
FIG. 14 PRIOR ART
FIG. 14 is a schematic cross sectional view taken along a cross sectional line XIV—XIV of FIG. 11.

Another embodiment of the present invention shown in FIG. 9 enables the function of the vehicle to be improved because it is arranged in such a manner that a partitioning bulkhead in the form of an insulating wall 70 is disposed adjacent to or in the vicinity of the aforesaid symmetric axis 28 of the vehicle so that the inside of the vehicle 27 is partitioned into a plurality of compartments in the form of a smoking-permitted room and a inhibited room. In this case, the first conduits 29 and 30 are respectively closed adjacent to the insulating wall 70. As a result, air in each of the compartments can be individually conditioned by the individual system arranged as shown in FIG. 10, and therefore the introduction of contaminated air in the smoking-permitted room into the smoking-inhibited room can be prevented. In other words, contaminated air in the smoking-permitted room will not be introduced into the smoking-inhibited room.

It can be seen that is not necessary for every compartment to have its own ventilating system. For example, in FIG. 9, the portion of the vehicle 27 to the left of partition 70 is divided into a plurality of compartments which share the first ventilating system, while the portion of the vehicle 27 to the right of partition 70 is divided into a plurality of compartments which share the second ventilating system. Thus, the vehicle 27 may comprise a plurality of groups of compartments, with each group having its own ventilating system.

The present invention can be widely adapted to another vehicle or a facility as well as the railway vehicle.

By introducing and jetting air 55 and 56 discharged through outlet ports of the ventilating means 53 and 54 into underfloor equipment disposed below the floor 33, the underfloor equipment can be cooled.

As described above, according to the present invention, conditioned air supplied from the air conditioning means is introduced into the first conduit disposed in the upper portion of the vehicle so as to be supplied into the compartment, the second conduit for sucking air in the compartment and for circulating it is disposed in the lower portion of the vehicle, air which has been passed through the second conduit is introduced into the air conditioning means, and the air conditioning means is also supplied with outdoor fresh air by the suction mean of the ventilating means so that air is conditioned. Furthermore, the third conduit is disposed in the lower portion of the vehicle so that air in the compartment is, via the third conduit, exhaust to the outside of the vehicle via the exhaust means of the ventilating means. As a result, the present invention enables the structure to be simplified, a complicated labor required when it is manufactured to be eliminated, a desired air conditioning performance to be kept, and noise to be eliminated while keeping a proper air quantity and wind velocity.

The structure according to the present invention is arranged in such a manner that the two systems of the ventilating apparatus are provided in the compartment and at least of the first conduit of the aforesaid ventilating apparatuses is connected to each other by the connecting conduit, so that a problem taken place in that one of the ventilating apparatuses has encountered a malfunction can be overcome by continuing the desired ventilation and the air harmonization by means of the residual ventilating apparatus.

Furthermore, the structure according to the present invention is arranged in such a manner that the inside of a vehicle is partitioned into a plurality of compartments as desired, and each of the partitioned compartments has a ventilating system including first, second, and third conduits, air conditioning means, and ventilating means, so that air of each of the compartments can be individually conditioned and ventilated while preventing contaminated air from being introduced into the other compartments. Therefore, the atmosphere of each of the compartments can be maintained satisfactorily.

In addition, even if a lavatory is placed in the compartment, propagation of odor in the compartment can be prevented because the exhaust port of the lavatory is connected to the third conduit.

As described above, the present invention is able to improve the practical advantage of a conveyance.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. A ventilating apparatus for a vehicle having a compartment with a floor comprising:

a first conduit extending in a longitudinal direction of the vehicle along an upper portion of the vehicle and communicating with the compartment for supplying conditioned air into the compartment;

a second conduit extending in the longitudinal direction of the vehicle adjacent the floor and communicating with the compartment for transporting return air from the compartment;

a third conduit for exhaust air extending in the longitudinal direction of the vehicle along the floor of the compartment and communicating with the compartment;

ventilating means connected to the third conduit for drawing in air from outside of the vehicle and for exhausting air from the third conduit to the outside of the vehicle;

air conditioning means disposed beneath the floor of the vehicle for mixing air drawn in from outside of the vehicle via the ventilating means and return air transported from inside of the compartment via the second conduit to produce conditioned air;

a horizontal conduit disposed beneath the floor of the compartment and connected to the air conditioning means; and a rising conduit connected between the horizontal conduit and the first conduit.

2. A ventilating apparatus for a vehicle according to claim 1 wherein the third conduit extends into and communicates with a lavatory of the vehicle for exhausting air from the lavatory.

3. A ventilating apparatus for a vehicle according to claim 1 wherein the ventilating means comprises suction means for drawing in air from outside of the vehicle and exhaust means for exhausting air from the vehicle.

4. A ventilating apparatus for a vehicle according to claim 1 including silencing means for silencing the rising conduit.

5. A ventilating apparatus for a vehicle according to claim 1 wherein the second and third conduits are disposed along widthwise opposite sides of the compartment.

6. A ventilating apparatus for a vehicle having a compartment with a floor comprising:

first and second air conditioners disposed beneath the floor;

a pair of first conduits each extending along an upper portion of the vehicle in a longitudinal direction of the vehicle and each communicating with the compartment and one of the air conditioners for supplying conditioned air to the compartment;

a pair of second conduits for return air extending beneath the floor in the longitudinal direction of the vehicle and each communicating with the compartment and one of the first and second air conditioners;

a pair of third conduits for exhaust air each extending beneath the floor in the longitudinal direction of the vehicle and communicating with the compartment; and first and second ventilating means for exhausting air from the third conduits to the outside of the vehicle, the first ventilating means being connected to one of the third conduits and the second ventilating means being connected to the other of the third conduits.

7. A ventilating apparatus for a vehicle according to claim 6 wherein the pair of first conduits are connected to each other.

8. A ventilating apparatus for a vehicle according to claim 6 wherein the vehicle includes at least one partition dividing the compartment into a plurality of sections separated in the longitudinal direction of the vehicle, one of each of the first, second, and third conduits being disposed in one of the sections, and the others of the first, second, and third conduits are disposed in the other section.

9. A ventilating apparatus for a vehicle having a compartment comprising:

at least one first conduit extending in a longitudinal direction of the vehicle for supplying conditioned air to the compartment;

at least one second conduit for return air extending in the longitudinal direction of the vehicle and communicating with the compartment;

at least one third conduit for exhaust air extending in the longitudinal direction of the compartment and communicating with the compartment, each third conduit overlapping the at least one second conduit in the longitudinal direction and being disposed on a widthwise opposite side of the compartment from an overlapped second conduit;

ventilating means connected to the at least one third conduit for exhausting air from the compartment through the at least one third conduit to outside of the vehicle; and air conditioning means for supplying the at least one first conduit with conditioned air.

10. A ventilating apparatus for a vehicle according to claim 9 wherein the compartment includes a lavatory, the at least one second conduit is spaced from the lavatory and one of the at least one third conduit extends into and is in communication with the lavatory.

11. A ventilating apparatus for a vehicle according to claim 10 wherein one of the at least one first conduits extends into and is in communication with the lavatory.

12. A ventilating apparatus for a vehicle according to claim 9 wherein the compartment includes a floor, the at least one first conduit is disposed along an upper portion of the compartment, and the at least one second and third conduits are disposed adjacent the floor.

13. A ventilating apparatus for a vehicle according to claim 12 wherein the at least one second and third conduits are disposed beneath the floor.

14. A ventilating apparatus for a vehicle having a compartment with a floor, the ventilating apparatus comprising a plurality of ventilating systems, each ventilating system comprising:

a first conduit for conditioned air extending in a longitudinal direction of the vehicle along an upper portion of the vehicle and communicating with the compartment for supplying conditioned air into the compartment;

a second conduit for return air extending in the longitudinal direction of the vehicle along the floor and communicating with the compartment for transporting return air from the compartment;

a third conduit for exhaust air extending in the longitudinal direction of the vehicle along the floor and communicating with the compartment for removing exhaust air from the compartment;

ventilating means connected to the third conduit for drawing in fresh air from outside of the vehicle and exhausting exhaust air from the third conduit to the outside of the vehicle;

air conditioning means disposed beneath the floor of the vehicle for mixing fresh air drawn in from outside of the vehicle via the ventilating means and return air transported from inside of the compartment via the second conduit to produce conditioned air;

a horizontal conduit for conditioned air disposed beneath the floor of the compartment and connected to the air conditioning means; and a rising conduit connected to the horizontal conduit and the first conduit.

15. A ventilating apparatus according to claim 14 wherein the third conduit of one of the ventilating systems extends into and communicates with a lavatory of the vehicle for exhausting air from the lavatory.

16. A ventilating apparatus according to claim 14 wherein each ventilating means comprises suction means for drawing in air from outside of the vehicle and exhaust means for exhausting exhaust air from the vehicle.

17. A ventilating apparatus according to claim 14 wherein one of the ventilating systems includes silencing means for silencing the rising conduit.

18. A ventilating apparatus according to claim 14 wherein the second and third conduits of each ventilating system are disposed along widthwise opposite sides of the compartment in an opposing relationship.

19. A ventilating apparatus according to claim 14 including separate air conditioning means and separate ventilating means for each ventilating system.

20. A ventilating apparatus according to claim 14 wherein the ventilating systems are isolated from one another.

21. A ventilating apparatus according to claim 14 wherein the first conduits of two of the ventilating systems are connected to one another.

22. A ventilating apparatus for a vehicle having a floor and a plurality of groups of compartments, each group including at least one compartment, the ventilating apparatus comprising a plurality of ventilating systems each corresponding to one of the groups of compartments, each ventilating system comprising:

a first conduit for conditioned air extending in a longitudinal direction of the vehicle and communicating with at least one compartment of the corresponding group;

a second conduit for return air extending along the floor of the vehicle in the longitudinal direction of the vehicle and communicating with at least one compartment of the corresponding group;

a third conduit for exhaust air extending in the longitudinal direction of the vehicle along the floor and communicating with at least one compartment of the corresponding group;

ventilating means connected to the third conduit for sucking fresh air from outside the vehicle and exhausting exhaust air from the vehicle;

air conditioning means for mixing fresh air from the ventilating means and return air from the second conduit to produce conditioned air;

a horizontal conduit for conditioned air connected to the air conditioning means; and a rising conduit for conditioned air connected to the horizontal conduit and the first conduit.

23. A ventilating apparatus according to claim 22 wherein one of the compartments is a lavatory, and the third conduit of one of the ventilating systems extends into and communicates with the lavatory for removing exhaust air from the lavatory.

24. A ventilating apparatus according to claim 22 wherein each ventilating means comprises suction means for drawing in fresh air from outside of the vehicle and exhaust means for exhausting exhaust air from the vehicle.

25. A ventilating apparatus according to claim 22 wherein each ventilating system includes silencing means for silencing the rising conduit.

26. A ventilating apparatus according to claim 22 wherein the second and third conduits of each ventilating system are disposed along widthwise opposite sides of the vehicle in an opposing relationship.

27. A ventilating apparatus according to claim 22 wherein adjoining groups of compartments are partitioned from one another and the second conduits of adjoining groups of compartments are isolated from one another to prevent air from being introduced from one group of compartments into another group of compartments.

28. A ventilating apparatus according to claim 22 wherein the ventilating systems are isolated from one another.

29. A ventilating apparatus according to claim 22 including separate air conditioning means and separate ventilating means for each ventilating system.

* * * * *